US005662170A

United States Patent [19]

Donovan et al.

[11] Patent Number: 5,662,170

[45] Date of Patent: Sep. 2, 1997

[54] METHOD OF DRILLING AND COMPLETING WELLS

[75] Inventors: Joseph F. Donovan; Michael H. Johnson; Daniel J. Turick, all of Spring, Tex.

[73] Assignee: Baker Hughes Incorporated, Houston, Tex.

[21] Appl. No.: 608,865

[22] Filed: Feb. 29, 1996

Related U.S. Application Data

[63] Continuation of Ser. No. 343,746, Nov. 22, 1994, abandoned.

[51] Int. Cl.[6] ..... E21B 7/20

[52] U.S. Cl. ..... 166/358; 166/278; 166/297; 175/57

[58] Field of Search ..... 166/358, 278, 166/297, 143, 188, 339; 175/57

[56] References Cited

U.S. PATENT DOCUMENTS

| | | | |
|---|---|---|---|
| 1,279,783 | 12/1918 | Stirling . | |
| 1,974,664 | 12/1934 | Patten | 255/61 |
| 2,229,493 | 1/1941 | Croft et al. | 255/1 |
| 2,726,847 | 12/1955 | McCune et al. | 255/1.6 |
| 2,778,603 | 1/1957 | McCune et al. | 255/1.6 |
| 3,463,228 | 8/1969 | Hearn | 166/181 |
| 3,880,233 | 4/1975 | Muecke et al. | 166/205 |
| 4,202,411 | 5/1980 | Sharp et al. | 166/244 |
| 4,239,084 | 12/1980 | Sharp et al. | 166/278 |
| 4,270,619 | 6/1981 | Base | 175/61 |
| 4,335,788 | 6/1982 | Murphey et al. | 166/278 |
| 4,372,384 | 2/1983 | Kinney | 166/297 X |
| 4,544,041 | 10/1985 | Rinaldi | 175/57 |
| 4,651,837 | 3/1987 | Mayfield | 175/262 |
| 5,148,875 | 9/1992 | Karlsson et al. | 175/62 |
| 5,197,553 | 3/1993 | Leturno | 175/57 |
| 5,219,025 | 6/1993 | Berger et al. | 166/278 |
| 5,234,055 | 8/1993 | Cornette | 166/278 |
| 5,253,708 | 10/1993 | Alexander | 166/278 |
| 5,255,741 | 10/1993 | Alexander | 166/278 |
| 5,320,178 | 6/1994 | Cornette | 166/278 X |
| 5,343,949 | 9/1994 | Ross et al. | 166/278 |
| 5,368,110 | 11/1994 | French | 175/57 |
| 5,373,899 | 12/1994 | Doréet al. | 166/297 |

OTHER PUBLICATIONS

EBAA Iron Sales Inc., Wedge Action MEG A LUG, 6 pages.

*Primary Examiner*—William P. Neuder
*Attorney, Agent, or Firm*—Madan & Morris

[57] ABSTRACT

A method and assembly for completing a well is disclosed. Generally, the method comprises the steps of positioning a stationary string in the well at a first position. The stationary string will have connected thereto a completion device for completing the well to a reservoir and a detachment apparatus for detaching the completion device from the stationary string. The method further comprises the steps of positioning a secondary string in the well, with the secondary string having a cooperating detachment apparatus for detaching the completion member from the stationary string. Next, the completion member is detached from the stationary string and attached to the secondary string, and the completion member is positioned at a second position which corresponds to a hydrocarbon zone. In one embodiment, the stationary string is a production tubing string, and the production tubing is attached to an isolation safety valve member for isolating the well from pressure.

36 Claims, 8 Drawing Sheets

107

108
102
152
150
110
128
151
152

120
100
118
TARGET
RESERVOIR
158

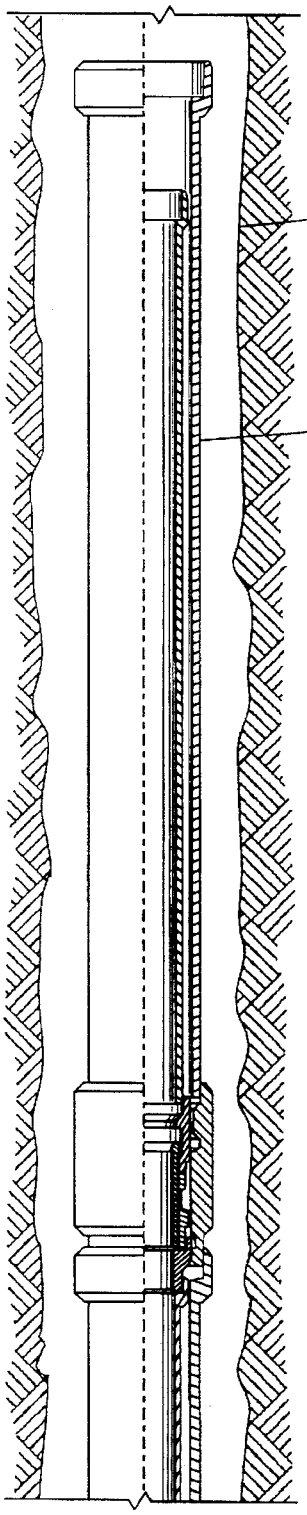
FIG. 7A
FIG. 7B
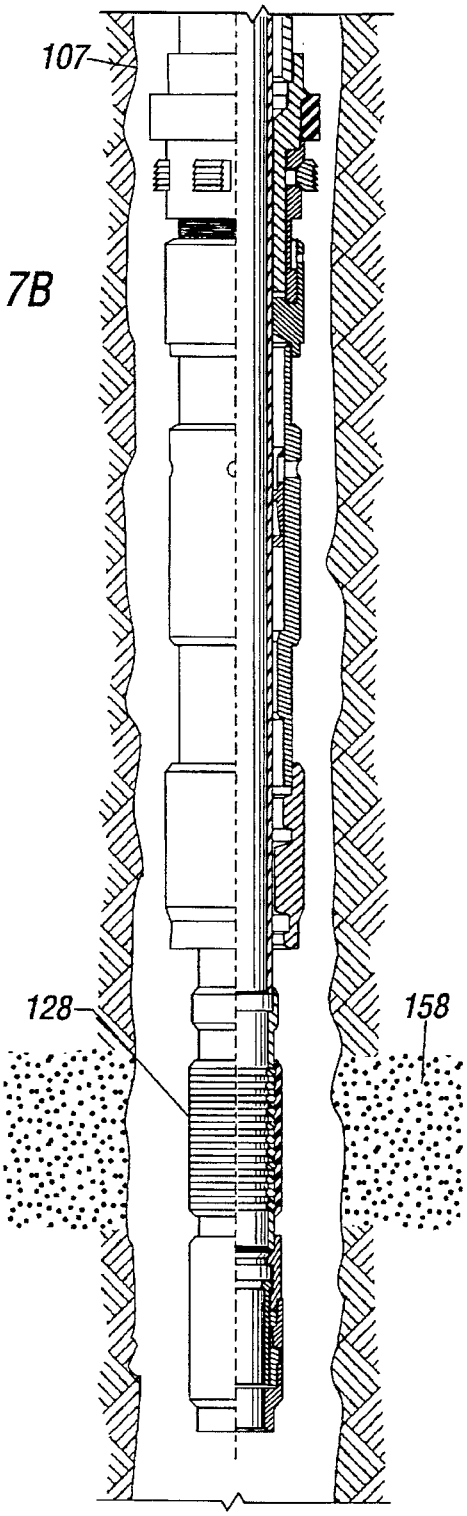

METHOD OF DRILLING AND COMPLETING WELLS

This is a continuation of application Ser. No. 08/343,746 filed on Nov. 22, 1994, abandoned.

FIELD OF THE INVENTION

The present invention relates to drilling and completing of wells. In particular, but not by way of limitation, the invention relates to drilling and completing of hydrocarbon wells.

BACKGROUND OF THE INVENTION

In order to recover hydrocarbons, a well is drilled into the ground until a hydrocarbon reservoir is encountered. In the earlier days of oil and gas exploration, most well sites were located onshore, and the wells that were drilled were primarily vertical. As the search for larger hydrocarbon reservoirs continues, the exploration is now focusing on offshore locations and remote land sites. Further, many wells are being drilled and completed as highly deviated and horizontal wells for economical and logistical reasons.

In offshore applications, one type of installation includes use of a fixed platform wherein the legs of the platform are rigid and embedded into the sea floor. The fixed platform has been a very popular type of structure; however, as the search for reserves continues, oil and gas companies find themselves searching in offshore locations were the water depths may be as deep as 6000 feet.

Regarding land locations, the exploration, drilling and production are now taking place in remote locations that may include arctic regions, desert regions, or even the rain forest of Latin America. Regardless of the inland or offshore location of due to, the remote nature of locations and the necessary ancillary equipment and personnel that must follow, the rental rates for these rigs are very significant.

In offshore waters, traditional fixed platforms can not be placed in depths generally greater than 300 feet. Therefore, tension leg platforms, drilling ships or semi-submersible drilling vessels are being used to drill these deep water wells. Typically, this involves the drilling rig being placed on the ship or floater. A sub-sea blow out preventor stack (BOP) is then placed on the ocean floor. A riser is then connected from the sub-sea BOP to the drill floor. The borehole can then be drilled.

Once the well has been drilled and a hydrocarbon reservoir has been encounter, the well is ready to be completed. Many sub-sea wells are completed as single satellite wells producing to a nearby platform. They are a means of producing field extremities that cannot be reached by directional drilling from an existing platform and where the economics do not justify the installation of one or more additional platforms. Some multi-well templates and piping manifolds have been installed that reach beyond the satellite well concept.

While the governments have recognized the importance and the necessity of drilling and completing wells in remote locations, significant regulations exist for each phase of the drilling, completing, and producing operation. When a certain size drill string is substituted for a second size, or alternatively, for production tubing, operators require changing of the BOP ram members so that control of the wellbore is always maintained. This is a crucial concern because control of the wellbore is essential at all times.

When the operator is converting from the drilling phase to the completion phase, the BOP stack must be changed to accommodate the different outer diameter sized work string—from drill pipe to a production string. Furthermore, during the actual completion phase, the production tubing must be manipulated in order to perform the necessary functions such as perforating, circulating, gravel packing and testing. According to established safety procedures mandated by operator rules and government regulations, it is necessary to change the BOP rams during certain phases. The changing of the BOP rams can be a costly and time consuming practice. Day rates for drill ships and semi-submersible ships can be quite expensive, and during the procedure for changing the rams, no other substantive operations can be accomplished.

In a typical offshore location, wherein the drilling rig is either a jack-up vessel or placed upon a fixed platform, the BOP is normally situated on the vessel or platform itself. Nevertheless, because of safety considerations and government regulations, the control of the well bore from blow-out is always of primary concern. Therefore, safety of the installation along with economically performing the operation has always been a need.

In order to minimize cost, several techniques have been employed with varying degrees of success. One technique has been to drill and case the well, and then immobilize the drilling rig. A replacement rig is then utilized to complete the well. The replacement rig may vary from a snubbing unit, coiled tubing unit, work over rig using smaller inner diameter pipe, and in some cases wire line. Thus, rather than completing the well with the more expensive rig, a less expensive rig is utilized. Therefore, there is a need to provide for a more cost effective means for drilling and completing wells in the exotic locations of the world.

SUMMARY OF THE INVENTION

In accordance with the present invention, there is provided a method of completing a well. The method includes the steps of positioning a stationary string in the well at a first position, with the stationary string having connected thereto a means for completing the well and a detachment means for detaching the completing means from the stationary string; positioning a secondary string in the well, with the secondary string having a cooperating detachment means for detaching the completing means from the stationary string; engaging the detachment means of the stationary string with the completion means; and positioning the completing means at a second position so that the well can be completed.

The stationary string of this method may be a production tubing string, wherein the production tubing is attached to an isolation safety means for isolating the well from pressure such as either the BOP's or christmas tree. Further, the completing means may contain perforating means for perforating the well in a subterranean reservoir.

In yet another embodiment, the completing means further contains screen means for preventing the flow of a formation sand from the subterranean reservoir into the inner diameter of the production tubing string. The completing means may further contain a gravel packing means for placing a gravel slurry in the annulus of the well and wherein the second position of the completing means corresponds to a position adjacent a target subterranean reservoir. In this embodiment, the method further comprises the step of activating the perforating means, then engaging the completion means and positioning the screen means to a third positions such that the third position is adjacent the target subterranean reservoir so that a gravel slurry is placed about the annulus of the screen means.

In the embodiments described, the secondary string may be a coiled tubing string, a smaller outer diameter drill string, or wire line. The detachment means may include a hang & release packer, hook wall packer, hydraulic set packer, all of which are commercially available from Baker Hughes Incorporated under the product name "SC" style packers, Retrievamatic, and Hang & Release Packers.

The method herein described may take place on a semi-submersible drilling vessel such that the BOP stack is located on the sea floor. In the alternative, the drilling rig could have been positioned on a jack-up or fixed platform wherein the BOP would have been located above the sea line.

Another method is disclosed for the drilling of a bore hole from a cased-hole well. The method comprises the steps of positioning a stationary string in the well, the stationary string having attached thereto a means for drilling a bore hole. The secondary string is run into the well bore having attached activation means for activating the drilling means; next, the secondary string is engaged with the drilling means and the well is drilled.

In this embodiment, the stationary string may be a production string, wherein the production string is attached to an isolation safety means for isolating the well and well bore hole from pressure. The isolation safety means may be either a BOP stack or christmas tree.

The drilling means may contain bit means for rotary drilling a bore hole; and, motor means for effecting rotation of the drilling means. The method would then constitute the further steps of circulating a fluid in the secondary string so that the motor means effects rotation of the bit means so that the bore hole is drilled through a target reservoir.

In yet another embodiment, the drilling means further contains an orienting means, operably connected a motor, for determining the direction and location of the bit means and generating a signal in response thereto a, logging means for evaluating the lithology of a subterranean reservoir for generating a signal in response thereto, and non-rotating means, operably connected on one end to the drill string and on the second end to the motor, for imparting selective rotation to the drilling means. In this embodiment, the step of drilling the bore hole comprises the steps of transmitting the signals from the orienting and logging means; plotting the path of the bit means in order to determine the location of the bit; steering the bit means in response to the bit location; and, drilling through the target reservoir.

In this embodiment, the drilling means may further contain a completing means for completing the well, which includes a screen portion. The screen portion may have a soluble compound disposed thereon. Thus, the method with this assembly would further comprise the process of positioning the screen adjacent to the reservoir; and, placing a gravel slurry in the well adjacent to the reservoir. In some situations, the logging means may also contain a nuclear source for determining the nuclear properties of the subterranean reservoirs, and therefore, it may also be desirable to retrieve the drilling means from the well.

In yet another embodiment, a method is disclosed that comprises the steps of positioning a stationary string in the well at a first position. The stationary string will have attached thereto a completing means for completing the well and lowering means for lowering the completion means. The method would include activating the lowering means so that the completion means is lowered to a second position, and thereafter, the well can be completed.

In the embodiment herein described, the stationary string is a production string which is attached to an isolation safety means for isolating the well from pressure of a subterranean reservoir. Also, the lowering means comprises pressure activating piston means, and the step of completing the well includes increasing the pressure in the well in order to activate the lowering means so that the completion means is lowered into the proper position adjacent the reservoir.

The completing means may contain perforating means for perforating the well in the reservoir, and the step of completing the well includes positioning the perforating means adjacent the reservoir and, perforating the reservoir.

This assembly may further contain screen means for preventing the flow of a formation sand from the subterranean reservoir into the inner diameter of the production tubing string, and the procedure includes increasing the pressure in the well in order to activate the lowering means and positioning the screen means adjacent to the reservoir.

One of the objects of this invention is to a production string that is stationary through the completion process. In other words, once the production string is in place, no further manipulation of the production string through out the completion process is necessary. Another object of the present invention is the ability of having a remedial Work over unit complete the well; therefore, once the production string is in place, the operator may then demobilize the more costly drilling rig.

Yet another object of the present invention includes the capability of enhancing the productivity of the reservoir since the method of drilling and completing allows for use of lighter, cleaner and environmentally safer drilling and completion fluids. A further object includes utilizing smaller quantities of drilling fluids during the drilling and completion phase since the annular area is smaller.

Another object includes the option of drilling into a target formation with a bottom hole assembly hung from the stationary tubing in the annulus, and then completing as an open hole completion. The bottom hole assembly may contain the drilling and completion means and be operationally attachable to the stationary string. Alternatively, the drilling and completion means may be connected to the production tubing so that the completion assembly may be drilled into place. Still another object includes drilling and completing directional and multi-bore wells faster and more economically.

A feature of the present invention includes use of a stationary string in the well. Another feature includes use of a secondary string which could be coiled tubing, electric line, wire line, braided line, snubbing string, and/or small outer diameter drill pipe.

Another feature includes employing a bottom hole assembly that is selectively detachable to a stationary string. Still another feature includes the use of an attachment means that can attach, detach, and reattach the bottom hole assembly to the stationary string at different locations on the stationary string. Another object is to use the attachment means to lower the perforating gun a desired place, fire the guns and then reposition the bottomhole assembly so that the screen means is adjacent the perforated zone.

Still yet another feature includes the use of gravel packing means on the bottom hole assembly which will allow the gravel packing of the well after the screen is in place. Another feature includes employing the drilling bottom hole assembly and completion bottom hole assembly in tandem when the well is being drilled with a secondary string. Thus, the target reservoir can be drilled and completed with the secondary string. This is less expensive because it will require a remedial work over unit, not the semi-submersible vessel, drill ship or jack-up.

Still another feature of this invention allows for the completion of the well without use of a secondary string such that the bottom hole assembly is attached to stationary string and is lowered by a means for lowering the bottom hole assembly.

An advantage of the present invention includes use of the stationary string as a production string so that the dynamic string employed can be a remedial work string, and therefore, the drilling rig moved off location. Another advantage includes use of orienting means while drilling such that the operator can steer the bit into the planned trajectory.

Another advantage includes use of logging means while drilling such that the operator can evaluate and coordinate the subterranean reservoirs and telemeter the data to the surface. Yet another feature is that a significant portion of the well can be drilled and cased before encountering the target reservoir, and thus, it is possible to drill the majority of the wellbore with relatively lighter environmentally sensitive fluids. Another advantage includes the ability to use completion fluids that contain fewer solids to expose the formation to less formation damage thereby providing for a better completion.

Another advantage includes the option of perforating overbalanced wellbores since the completion fluid is less damaging to the formation. Another advantage is the option of perforating underbalanced, operations-hole, since there is a cleaner fluid in the work string. Another advantage includes the ability to complete sub-sea wells without changing out the rams of the Blow Out Preventor stack since the production string may remain stationary through the completion process.

BRIEF DESCRIPTION OF THE DRAWINGS

FIGS. 7A–7B are a cut through section of the bottom hole assembly of FIGS. 6A–6B after the drilling means has been released.

DESCRIPTION OF THE PREFERRED EMBODIMENTS

Figure 1:
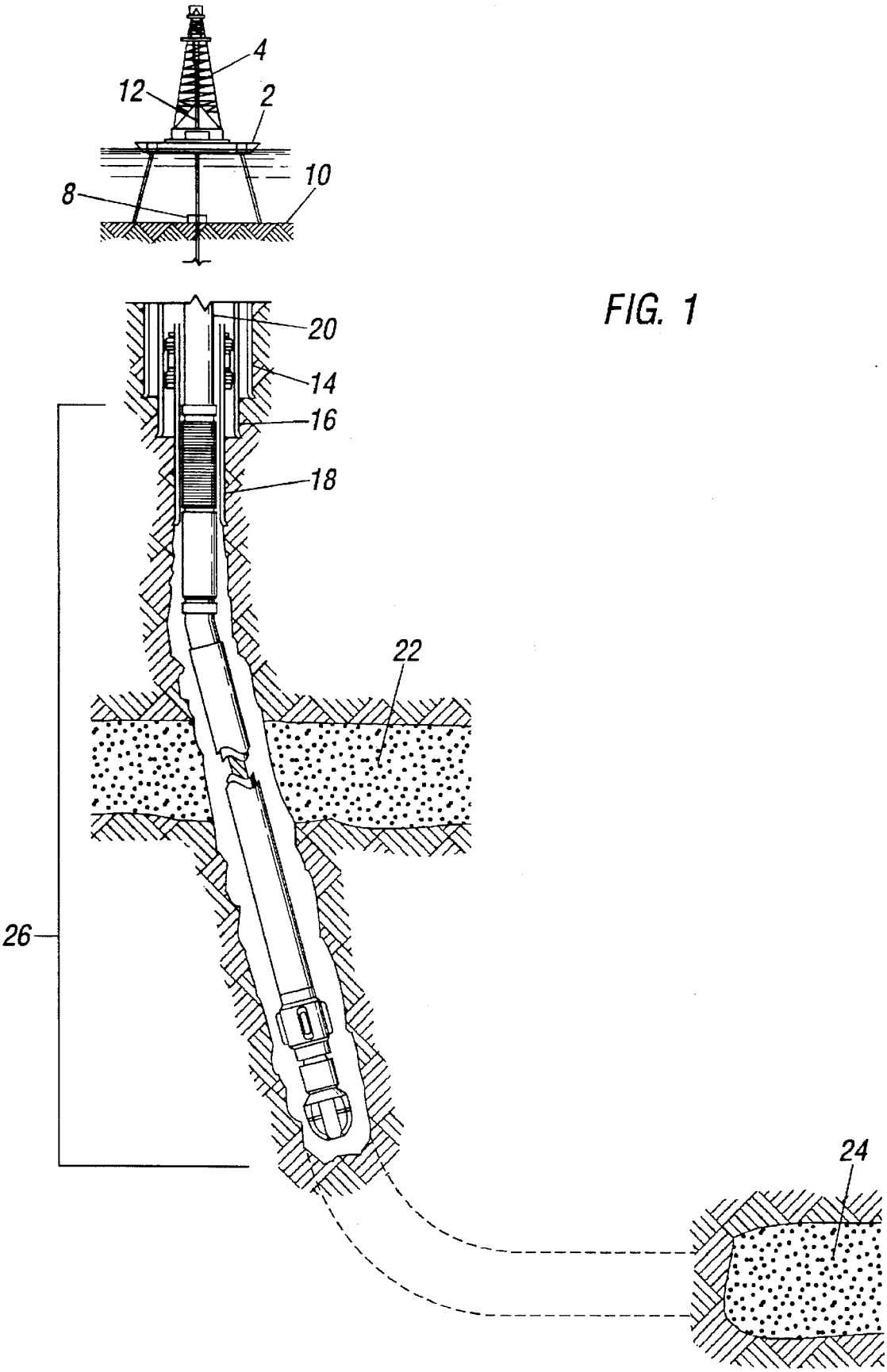
FIG. 1 is a semi-submersible drilling platform showing the drilling rig with casing and the target reservoir.

FIG. 1 depicts a semi-submersible drilling vessel 2 that has contained thereon a drilling rig 4. In order to control the pressures encountered from the subterranean reservoirs, a sub-sea Blow-Out Preventor stack 8 (also known as an isolation safety device for isolating the wellbore from the surface environment) is positioned on the ocean floor 10 with a riser 12 linking the sub-sea BOP stack 8 and the drilling rig. Extending into the earth from the sub-sea BOP stack 8 are the well casing, including a conductor, and intermediate string 14, 16, and 18, respectively. A stationary string 20 is positioned within the riser 12 and casing string 18.

As is well understood by those of ordinary skill in the art, the casing strings intersects various subterranean reservoirs 22, some of which may contain hydrocarbons. As is shown in FIG. 1, a target reservoir 24 has yet to be drilled through.

Figure 2A:
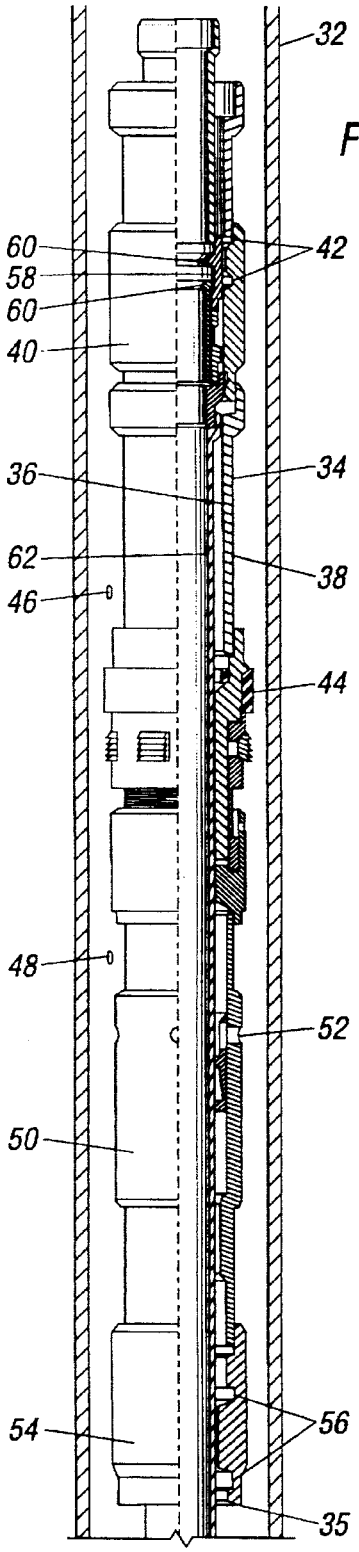
FIGS. 2A–2B are a cut through section of a bottom hole assembly being positioned in a well.
Figure 2B:
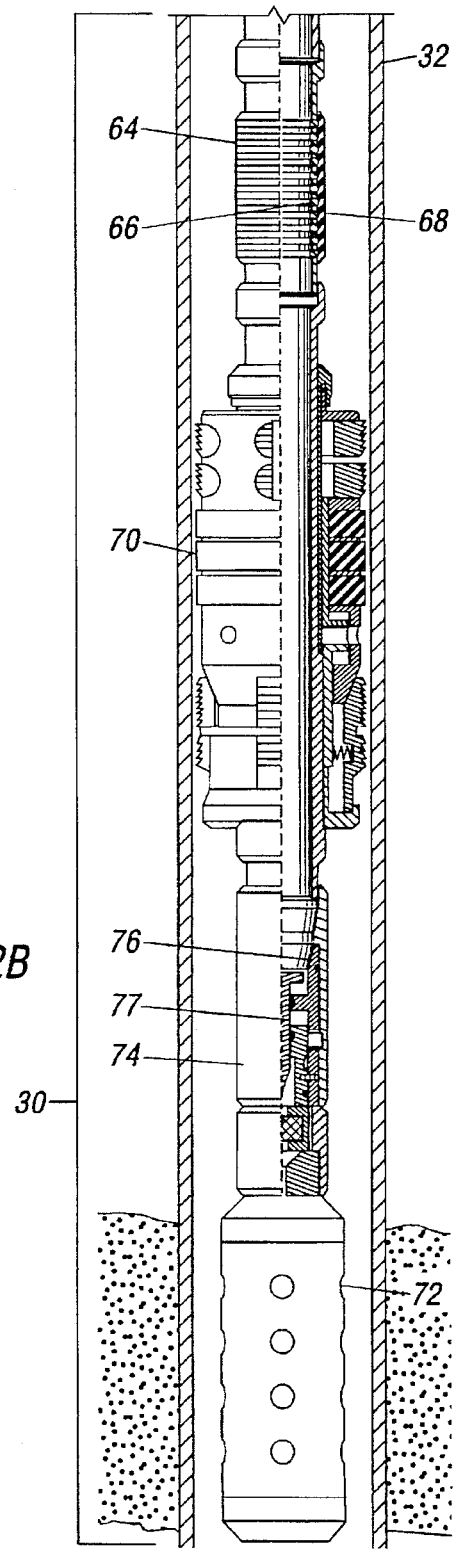

Referring now to FIGS. 2A–2B, a bottom hole assembly 30 is positioned within a casing string 32. Within the casing string 32 will be a stationary string 34 with an internal diameter 36 and an outer diameter 38, which in this illustration may be a production string, but it should be understood that the string may be other types of conduit including drill pipe. The stationary string will have included a nipple profile means 40 for the setting of various devices, with the nipple means 40 having an internal profile 42.

The stationary string 34 may also contain packer means 44 for sealingly engaging the inner diameter of the casing 32 so that when packer means 44 is set, an annulus between the string 34 and casing 32 is formed. The packer means 44 may be of the hydraulic and mechanical type and are commercially available from Baker Hughes Incorporated under the product name "SC" style packers. An upper annulus 46 is formed from the packer means 44 to the surface, and a lower annulus 48 is formed below the packer means 44. The string 34 may contains a gravel pack extension section means 50 for the placement of a gravel slurry through the ports 52 in the lower annulus 48, as will be more fully explained later. The gravel pack extension means 50 is commercially available from Baker Hughes Incorporated under the trade name "S-1" Gravel Pack Extension.

The string 34 may also contain a mechanical release profile means 54, which will have an internal profile 56, for the placement of a mechanical setting & release tool, as will be described hereafter.

The bottom hole assembly 30 will be attached to a release mechanism 58 that will contain collet members 60 that cooperate with the internal profile 42 of the nipple profile means 40. The release mechanism 58 may be attached to a section of blank pipe 62, that in turn will be connected to means for preventing the flow of formation sand 64. In the embodiment shown in FIG. 2B, the preventing means 64 is a section of perforated pipe 66 that is surrounded by a wrapped wire mesh segment 68.

The bottom hole assembly 30 will also consist of a packer means 70 for sealingly engaging with the well casing 32. The packer means 70 shown is a mechanical packer, however, any type of packer, such as hydraulic or rotational, commercially available from Baker Hughes Incorporated under the product names Model "R", and "SC-LP" packer could be used.

The assembly 30 will further contain perforating means 72 for perforating the casing 32 in a subterranean reservoir. In the embodiment shown, the perforating means 72 is a tubing conveyed gun; however, any other perforating means well known in the art could have been used. The perforating means 72 will be attached to the packer means 70, and the remainder of the bottom hole assembly 30 through a mechanical gun release means 74 for mechanically releasing the guns after firing. The release means 74 may be mechanical or hydraulic automatic gun release means. These release means 74 are also well know in the art, and are commercially available from Baker Hughes Incorporated under the product name Model "C" Auto Release Firing Head. The internal mechanism includes a piston release means 76 that is hydraulically activated.

In order to activate the perforating guns, either pressure activation and/or mechanical means can be used. In the preferred embodiment, the mechanical means 77 will be used which is commercially available from Baker Hughes Incorporated and referred to as the Mechanical Firing Head. The actual firing with the mechanical means is performed by dropping a metal bar or bars from the surface.

Figure 3A:
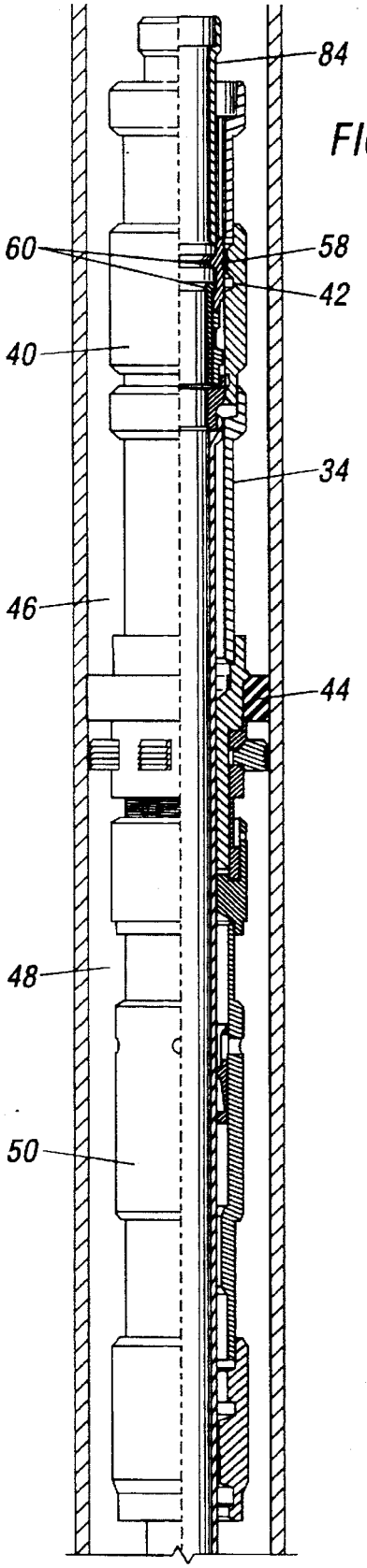
FIGS. 3A–3B are a cut through section of the bottom hole assembly of FIGS. 2A–2B after the perforating means have been released.
Figure 3B:
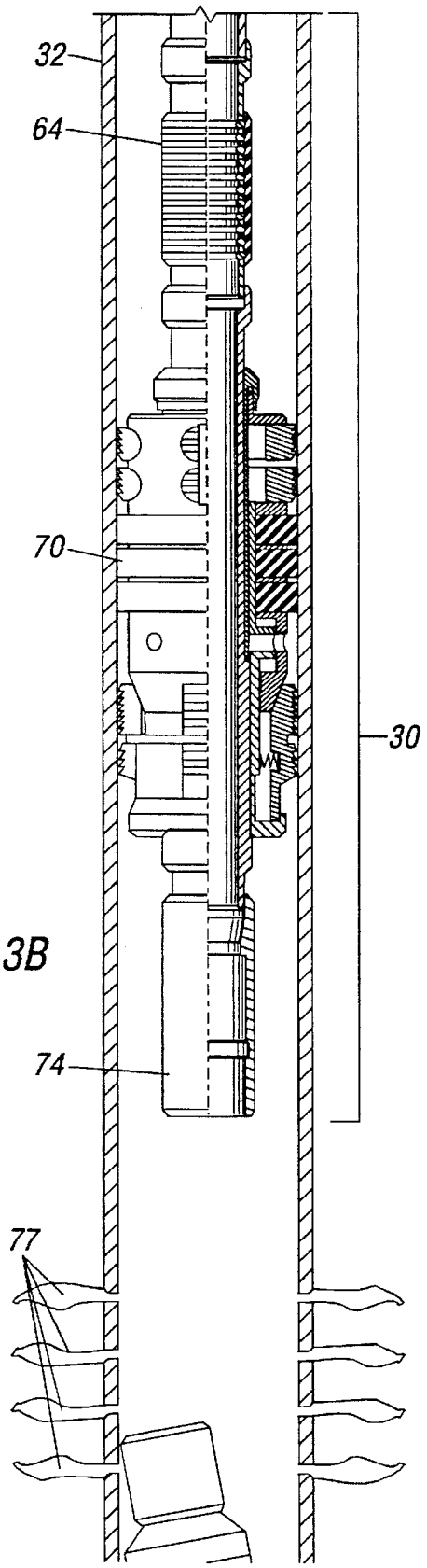

Referring now to FIGS. 3A–3B, the stationary string 34 and the bottom hole assembly 30 are shown after having fired with the perforating means 72 creating a series of perforating tunnels 77 that extend through the casing and into the formation. Thus, once fired, the pressures created due to the firing of the guns will activate the release means 74, 76. FIG. 3B depicts the perforating guns having been fired, lowered, and thereafter having been dropped from the bottom hole assembly 30.

Figure 4A:
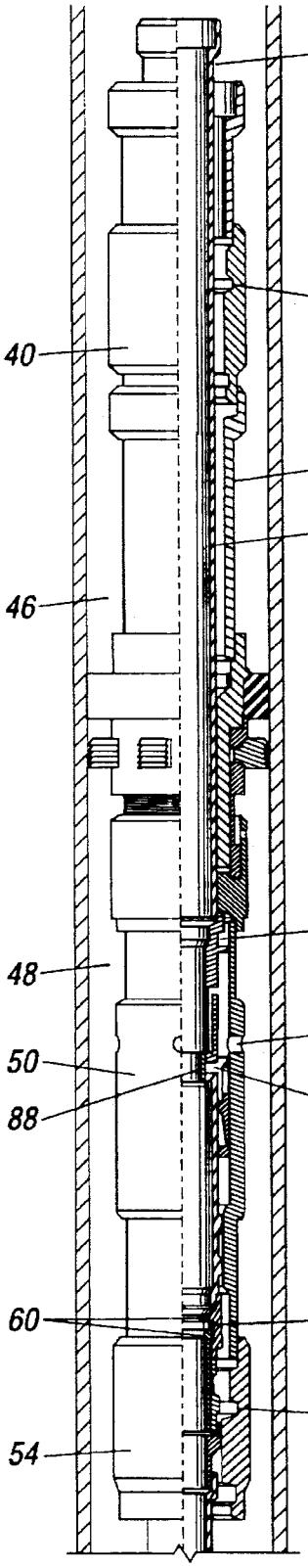
FIGS. 4A–4B are a cut through section of the bottom hole assembly of FIGS. 3A–3B having been engaged with gravel packing means on a coil tubing string.
Figure 4B:
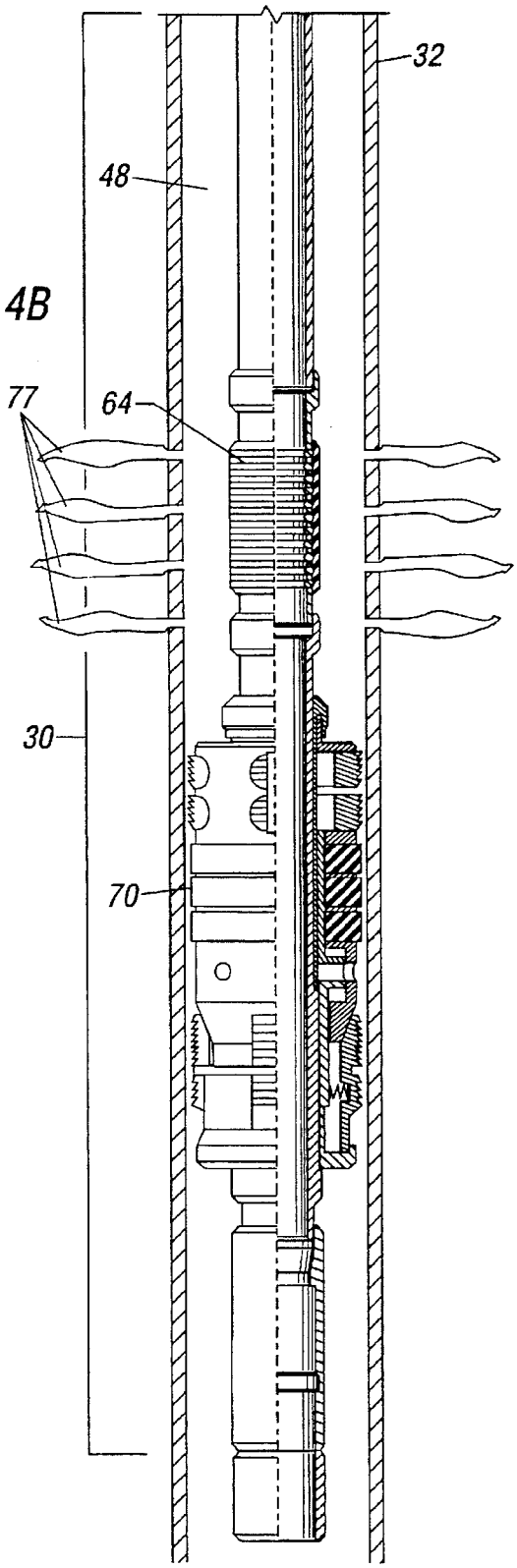

The illustration of FIGS. 4A–4B shows that a secondary string 84, which in the preferred embodiment is a coiled tubing string, is run into the well in the inner diameter 36 of the stationary string 34. The secondary string will have attached to it a crossover tool means 86 for aiding in the placing of a gravel slurry in the annulus area 48 adjacent the perforated casing as is well known in the art and is commercially available from Baker Hughes Incorporated under the product name Model "S-2" Crossover Tool. Also included will be the gravel pack extension means 50.

The crossover tool means 86 will contain a sliding sleeve member 88 that will shift to the open position by applying pressure in the inner diameter of the secondary string thereby exposing port 90 allowing an operator to gravel pack the perforated zone as is well known in the art.

Referring first to FIGS. 2A & 2B, the method of completing the well may be performed as follows. The stationary string 34 will be in place in the casing 32. The stationary string 34 will be in such a position that the bottom end 35 of the string 34 will be at a point above the reservoir that is to be completed.

The stationary string 34 will have attached thereto the bottom hole assembly 30 previously described, and the bottom hole assembly will be attached to the stationary string by means of the release mechanism 58, 60. The bottom hole assembly 30 will contain the screen means 64, sump packer means 70 and the perforating means 72, as has been previously described. The location of the bottom hole assembly at this location, and in particular the perforating means 72, places the assembly in a position to complete the well. In other words, the perforating means 72 in this first position will be adjacent the hydrocarbon reservoir. The perforating guns may be fired by applying internal diameter pressure through the stationary string or annulus pressure or by mechanical means such as dropping a weight bar.

Next, the perforating guns may be disengaged from the bottom hole assembly by hydraulic means such that the guns fall to the bottom of the well bore, as shown in FIGS. 3A–3B.

Following this, the secondary string 84, which in the embodiment in FIGS. 3A–3B and FIGS. 4A–4B is a coiled tubing string, is then positioned in the well. It is to be understood that other types of remedial work strings could have been used, such as wire line, electric line, braided line, snubbing pipe, small diameter drill pipe, etc. The coiled tubing 84 will engage in the release mechanism 58, 60 which will detach the bottom hole assembly 30 from the stationary string 34 from the mechanical release 40 and profile 42. The secondary string 84 can then be moved downward and the release mechanism 58, 60 will then be located within the mechanical release profile 54, 56. At this position, the screen means 64 will now be adjacent the perforated reservoir interval.

The crossover tool 86 as shown is part of the secondary string or it may be run separately such that port 90 will be in a location such that during a gravel pack operation, the gravel slurry will travel down the inner diameter of the coiled tubing 84, and cross over, via the cross-over tool 86, to the annulus 48 through ports 90 and 52.

Once the gravel slurry has been placed in the appropriate annulus space and perforated zones, the coiled tubing 84 and crossover tool 86 may be disengaged from the release means 58, 60, and the coiled tubing may be removed from the well.

Figure 5A:
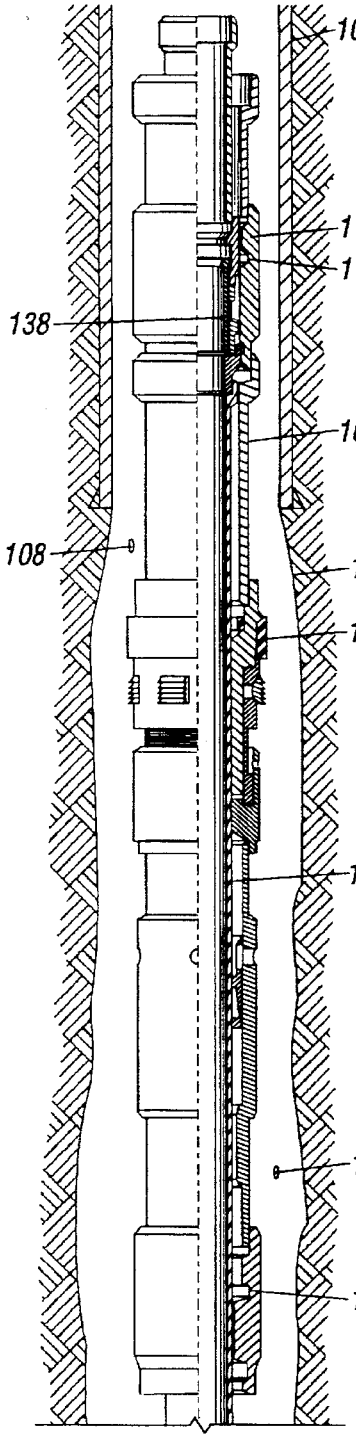
FIGS. 5A–5B are a cut through section of a bottom hole assembly containing drilling means being positioned in a well.
Figure 5B:
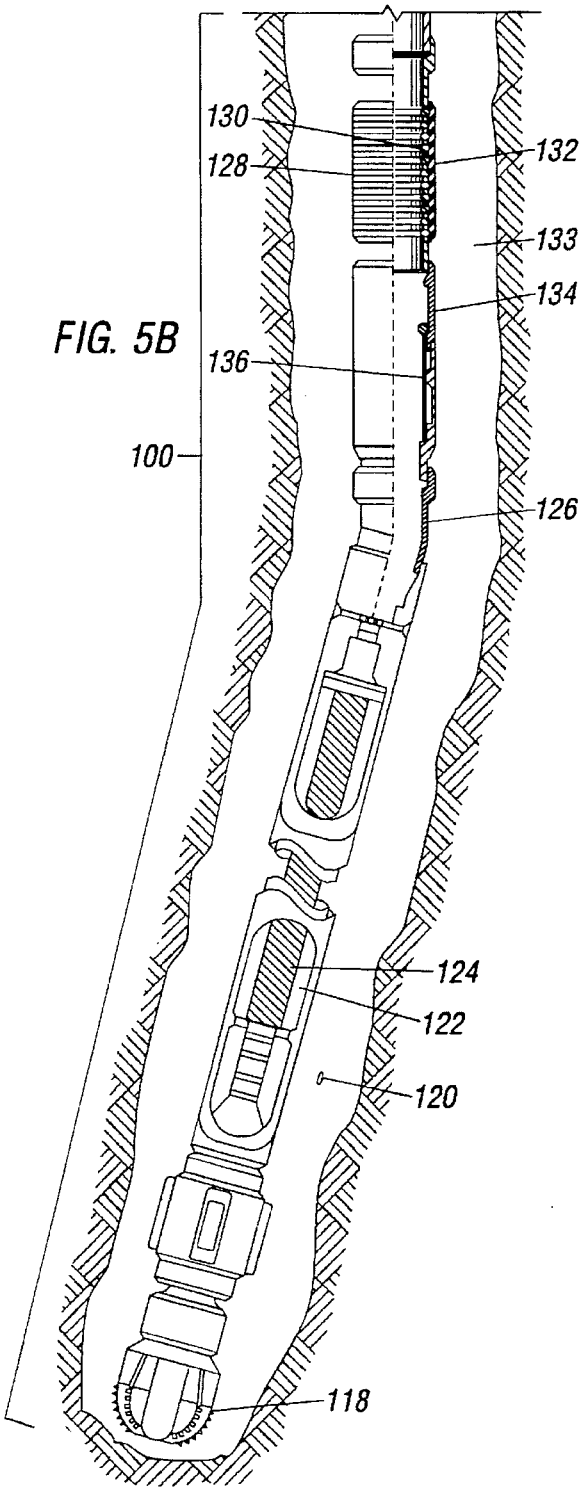

Referring now to FIGS. 5A–5B, a second embodiment of this invention which depicts the drilling and completing method and apparatus will now be described. In FIG. 5B, the bottom hole assembly 100 will be attached to a stationary string 102 as seen in FIG. 5A. The stationary string 102 will contain a packer means 104 for sealingly engaging the casing string 106, or alternatively the open hole 107, so that an upper annulus 108 and lower annulus 110 is formed.

The stationary string 102 may contain a releasing means 112 for releasably attaching and detaching a secondary string (which will be described in detail hereinafter), with the releasing means containing necessary nipple profiles 114.

Referring again to FIG. 5B, the bottom hole assembly 100 will consist of bit means 118 for drilling a bore hole, with the bit means depicted being a tri-cone rotating bit; however, it should be understood that other types of bit means, such as diamond bits may be employed. The assembly 100 will further consist of a motor means 120 for effecting rotation to the bit means, which in FIG. 5B is a stator 122 and rotor 124 assembly well known in the art.

The motor means 120 will in turn be connected to the deflection means 126 for causing a deflection in the bottom hole assembly so that the trajectory of the drilling path is curved. While a deflection means 126 has been shown, the teachings of this invention are certainly applicable to vertical hole completions. The deflection means 126 may be of the type where the angle of deflection is manipulated at the surface and run into the well bore, or alternatively, the deflection means 126, and in particularly the angle of deflection, is automatically controllable by transmitting a signal downhole by means of mud pulse, or acoustic telemetry.

The operator may choose to have a non-rotating swivel means such as a Model "A" Swivel, which is a non-rotating means, in the string; the non-rotating swivel means is not shown and is optional. As seen in FIG. 5B, the deflection means 126 will be attached to a detaching means 134 for releasing the motor means 120 and bit 118 from the assembly 100. In turn, the bottom hole assembly will have attached means for preventing sand production 128, which in the embodiment shown is a sand control means in that there is a segment of perforated pipe 130 that has disposed about it a wire-wrapped screen 132. A soluble means, disposed about the sand control means, may be added for preventing the contamination of the sand control means from the drilling fluids and cuttings encountered during the drilling, and completion of the well. The soluble means may also form an impermeable barrier so that fluids can not penetrate through the porous screen 128. The soluble means may be a wax composition; however, other types of compositions are available. The actual soluble means employed will depend on the downhole temperature and the wellbore fluid composition.

Other types of preventing means can be employed such as a slotted liner well known in the art. The inner diameter of the sand preventing means 128 is denoted as 133. The detaching means 134 for detaching the preventing means 128 from the deflection means 126 and the remainder of the bottom hole assembly 100 is a releasable mechanism means that has contained thereon engaging collet members 136 that is well known in the art that is commercially available from Baker Hughes Incorporated and sold under the product name Mechanical Release Sub.

As seen in FIG. 5A, there will also be a releasing means 138 for releasing the secondary string from the bottom hole assembly 100. A spacer pipe 139 will connect the screen means 128 and the release mechanism means 138.

Figures 6A, 6B:
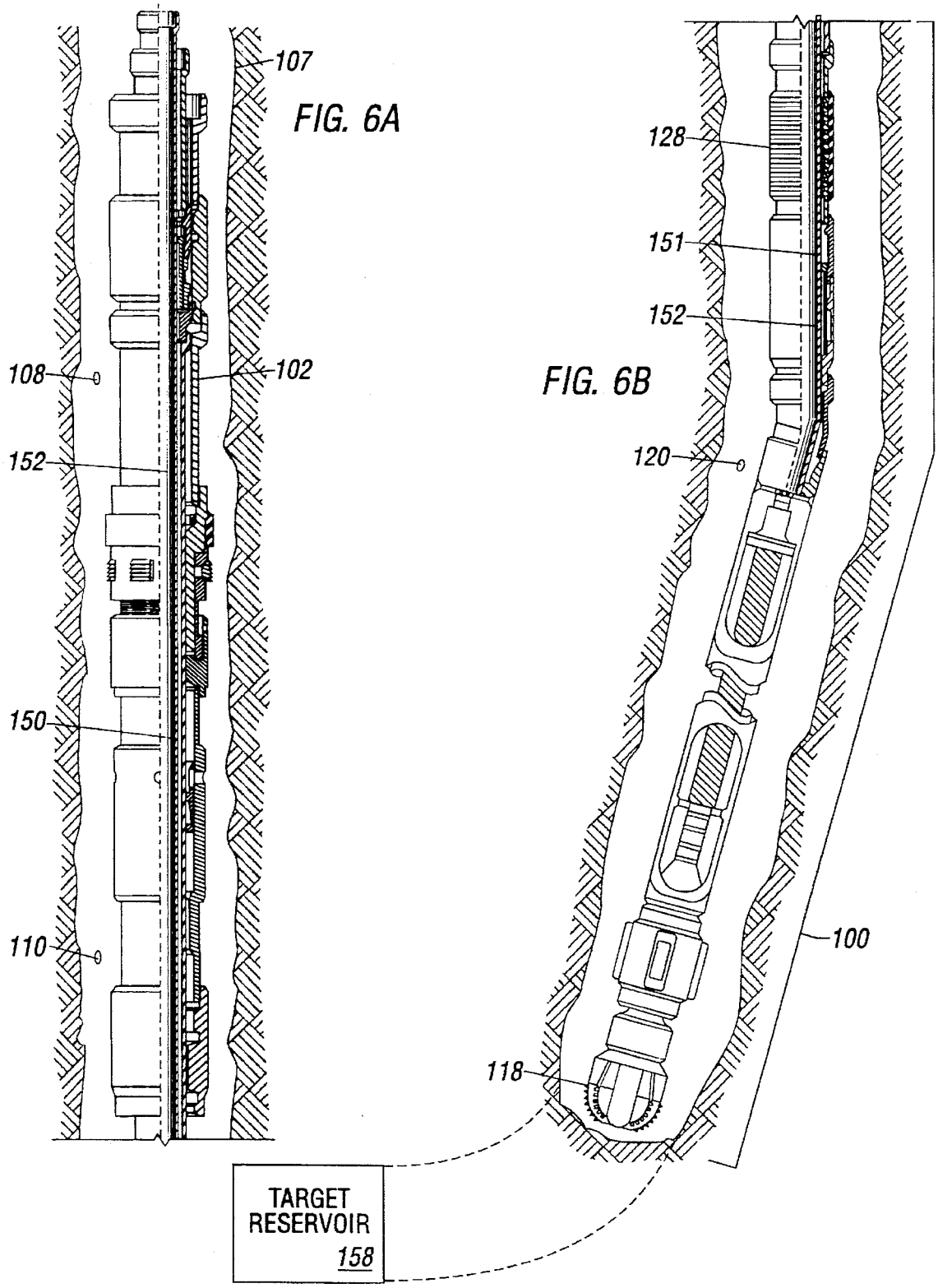
FIGS. 6A–6B are a cut through section of the bottom hole assembly of FIGS. 5A–5B drilling a bore hole.

With reference to FIGS. 6A–6B, the bottom hole assembly 100 is depicted wherein the bottom hole assembly 100 has connected thereto a secondary string 150, which in this case is a coiled tubing string, and the secondary string is in the process of drilling to a target reservoir 158. In the embodiment shown, the stationary string 102 is a production tubing string even though other types of conduits could be used such as a stationary drill string. The shifting tool 151, operably connected to the secondary string 150, is used in order to release the drilling bottomhole assembly from engagement with the completion equipment to enable further drilling.

Thus, for drilling to occur as shown in FIGS. 6A–6B, a drilling fluid is pumped down the inner diameter 152 of the coiled tubing 150 and into the motor means 120 thereby effecting rotation of the bit means 118. The coiled tubing 150 acts as is the drilling conduit and during drilling the fluid flow is out of the bit 118 and into the annulus 108 which includes the cuttings and circulation of the drilling fluids in the open hole section as well as the cased hole section.

While not depicted in the drawings, it is possible to include in the bottom hole assembly an orienting means, operably associated with the motor, for determining the direction and location of the bit means and generating a signal in response thereto. Also, logging means for evaluating the lithology of a subterranean reservoir and generating a signal in response thereto, and non-rotating means, operably connected on one end to the drill string and on the second end to said motor, for imparting selective rotation to the bit means.

In order to drill and complete to the target reservoir 158, the procedure first comprises pumping a drilling fluid down the stationary string 102 thereby effecting rotation of the drilling means 118; next, orienting means and logging means will generate a representative signal, and those signals will be transmitted to the surface. The path of the bit means may then be plotted in order to determine the location of the bit. The driller can then steer the bit means in response to the bit location, and ultimately drill through a target reservoir 158 with use of the bit means. The next step is to disengage the drilling assembly, which includes the deflection means 126, motor means 120 and bit means 118. The shifting tool 151 can be utilized to release the drilling bottom hole assembly from engagement with the remainder of the string and the secondary string 150 is removed from the well. The shifting tool is activated by longitudinal movement of the secondary string.

Referring to FIGS. 7A & 7B, a bore hole 107 has been drilled such that the target reservoir 158 has been encountered and the bore hole drilled to a sufficient depth so that the sand prevention means 128 can be lowered to a position adjacent the target reservoir 158. As can be seen, the drilling assembly has already been disengaged utilizing the previously described shifting tool 151. The secondary string 152 has been removed from the wellbore.

Figure 8A:
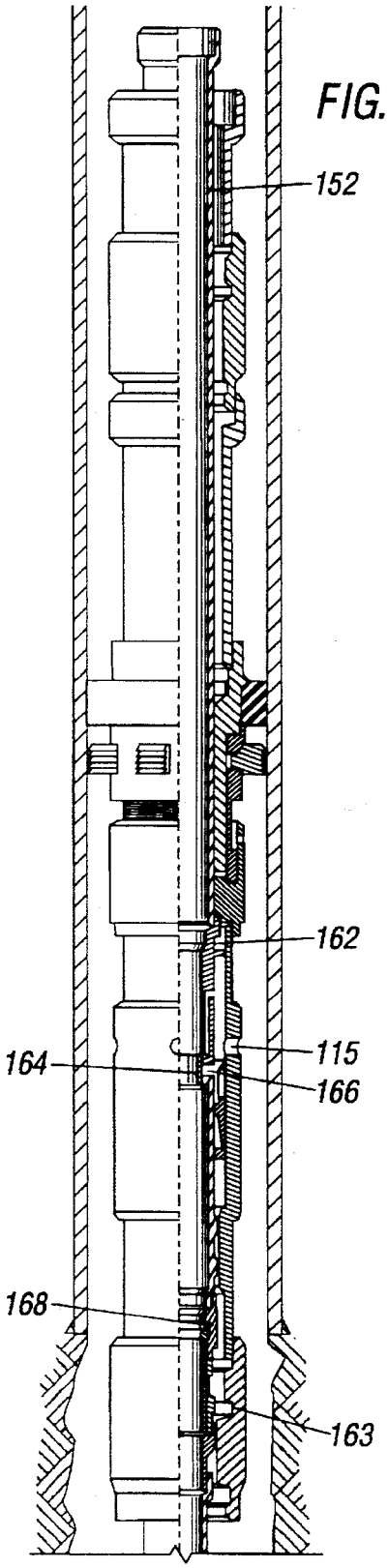
FIGS. 8A–8B are a cut through section of the bottom hole assembly of FIGS. 7A–7B having been engaged with gravel packing means on a coil tubing string.
Figure 8B:
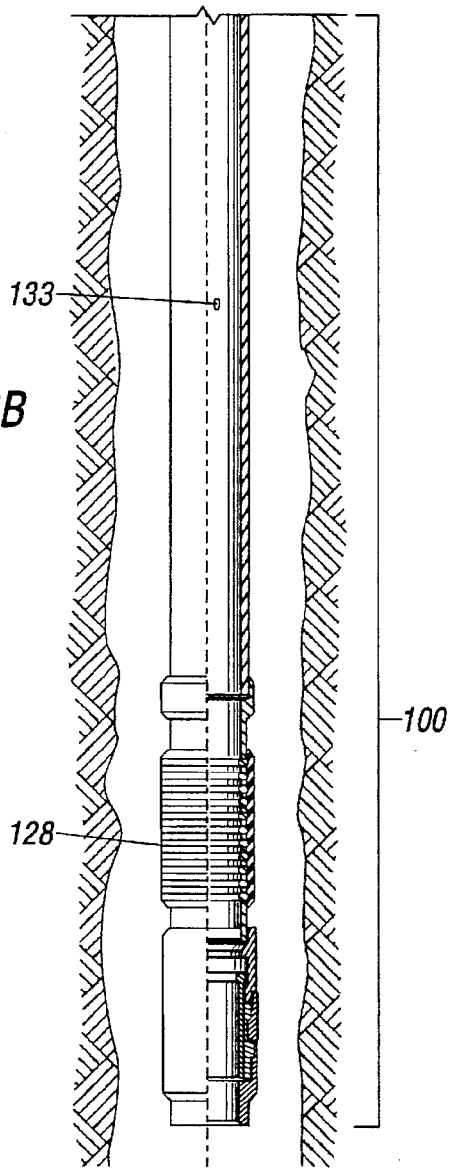

Referring now to FIGS. 8A & 8B, the secondary string 152 is again lowered into the well, this time having a cross-over tool means 162 attached thereto. A sliding sleeve member 164 is provided for selective opening on the cross-over tool means 162.

The crossover tool means 162 will engage the release mechanism means 168 and the bottom hole assembly 100 (which now only contains the sand control means 128) will be connected again to the secondary string 152. The secondary string 152 can be repositioned so that the release mechanism means 168 will now cooperate and engage with the release seat profile 163. At this position, the crossover tool means 162 will also engage with the gravel pack extension 114, and the gravel pack operation may be performed.

The crossover tool 162, and in particular port 166, will be in a location such that during a gravel pack operation, the gravel slurry will travel down the inner diameter of the coiled tubing, and cross over, via the cross-over tool 162, to the annulus 110 through ports 115 and 166.

Once the gravel slurry has been placed in the appropriate annulus space and perforated tunnels, the coiled tubing may be disengaged from the release means 168, which is commercially available from Baker Hughes Incorporated under the product name Shifting Tool, and the secondary string may be removed from the well. The well can now be placed on production with the fluids and gas traveling through the gravel pack, into the inner diameter 133 of the bottom hole assembly and then through the inner diameter of the stationary string in order to be produced.

Changes and modifications in the specifically described embodiments can be carried out without departing from the scope of the invention which is intended to be limited only by the scope of the appended claims.

What is claimed is:

1. A method of completing a wellbore comprising:

(a) positioning a stationary string in the wellbore at a first position, said stationary string having connected thereto a completion assembly which is adapted to perform a selected completion operation in the wellbore and a first detachment device for detaching said completion assembly from said stationary string;

(b) positioning a secondary string in the wellbore, said secondary string having a second detachment device for detaching said completion assembly from said stationary string;

(c) engaging said second detachment device with said completion assembly, thereby detaching the completion assembly from the stationary string and attaching it to the secondary string;

(d) positioning said completion assembly at a second position that is spaced from the first position by utilizing the secondary string;

(e) operating the completion assembly to perform the selected completion operation at the second position in the wellbore.

2. A method of drilling a borehole from a cased hole comprising:

(a) positioning a stationary string in said cased hole, said stationary string having detachably attached thereto a drilling assembly, said drilling assembly having a drill bit at an end thereof for drilling the borehole;

(b) conveying a secondary string in the cased hole, said secondary string adapted to detach the drilling assembly from the stationary string and attach it to the secondary string, said secondary string further adapted to activate the drilling assembly to cause the drill bit to drill the borehole when said drilling assembly is detached from the stationary string; and (c) activating the drilling assembly by utilizing the secondary string to drill the borehole past the cased hole.

3. An assembly for completing a well in a subterranean reservoir, the well containing a cased hole portion with production tubing placed concentrically therein, said production tubing attached to an isolation safety member for isolating the well from a reservoir pressure, the assembly comprising:

(a) a secondary string adapted to be positioned in the stationary string at a first position;

(b) a completion assembly attached to said secondary string for completing said well, said completion assembly including a perforating device for perforating the well; and (c) a detachment member, operably associated with said completion assembly, said detachment member enabling detaching said completion assembly from said secondary string and attaching the completion assembly to said stationary string at a second position spaced apart from the first position.

4. An assembly for completing a well, said well containing a cased hole portion, the assembly comprising:

(a) a production string disposed concentrically within said cased hole portion, wherein said production string is attached to an isolation safety member for isolating the well from a reservoir pressure;

(b) a completion assembly, operably connected to said stationary string, for completing said well to a target reservoir and wherein said completion assembly contains a perforating device; and (c) a lowering device, attached to said stationary string, for selectively lowering said completion assembly to a first and a second spaced apart position in said well.

5. A method for forming a wellbore, comprising:

(a) positioning a stationary string at a desired position within the wellbore, the stationary string having a detachable assembly which is adapted to perform a desired downhole operation in the wellbore;

(b) positioning a secondary string in the stationary string, said secondary string having a device attached thereto for detaching the assembly from the stationary string and for attaching the assembly to the secondary string;

(c) detaching the assembly from the stationary string and attaching it to the secondary string; and (d) moving the secondary string so as to move the assembly to a second position in the wellbore; and (e) operating the assembly to perform the desired bottomhole operation at the second position.

6. The method of claim 5, wherein the stationary string is adapted to engage the assembly at at least two spaced locations within the stationary string.

7. The method of claim 6, wherein performing the desired bottomhole operation further comprises: (i) performing a first operation by the assembly when it is engaged at one of the at least two spaced locations (ii) repositioning the assembly to the other spaced location by the secondary string and (iii) performing a second downhole operation by the assembly.

8. The method of claim 5, wherein the stationary string includes a production tubing that is attached to an isolation safety device for isolating the wellbore from the outside environment.

9. The method of claim 5, wherein the secondary string includes a perforating device for perforating holes in a downhole formation.

10. The method of claim 9 further comprising firing the perforating gun at a known location within the wellbore to perforate the downhole formation.

11. The method of claim 9, wherein the secondary string further includes a screen device for preventing entry of debris from the perforated formation into the stationary string.

12. The method of claim 11 further comprising repositioning the bottom hole assembly by the secondary string so as to place the debris preventing device adjacent the perforations in the wellbore.

13. The method of claim 10 further comprising packing gravel along a region outside the stationary string by a gravel packing device attached to the assembly.

14. The method of claim 5, wherein the assembly includes a drill bit.

15. The method of claim 14, wherein the assembly includes a motor operatively coupled to the drill bit for rotating the drill bit and the secondary string is adapted to allow a pressurized fluid to pass therethrough for operating the motor.

16. The method of claim 15 further comprising operating the motor to further drill the wellbore by injecting the pressurized fluid into the secondary string.

17. A method for forming a wellbore, comprising:

(a) positioning a stationary string at a desired position within the wellbore, the stationary string having a detachable bottomhole assembly containing (i) a perforating device for perforating the wellbore formation, (ii) a device for preventing sand from entering from the wellbore into the stationary string, (iii) a packer for providing a seal between the stationary string and the wellbore formation;

(b) activating the perforating device to perforate the wellbore;

(c) detaching the bottomhole assembly from the stationary string by a secondary string and attaching it to the secondary string;

(d) repositioning the bottomhole assembly so as to place the debris preventing device adjacent the perforations in the wellbore; and (e) sealing a region on either side of the perforations in the wellbore by the packer.

18. The method of claim 17, wherein the perforating device is adapted to automatically detach by forces generated upon the activation of the perforating device.

19. A method for drilling a wellbore, comprising:

(a) drilling an initial portion of the wellbore;

(b) positioning a first string at a desired position within the initial portion of the wellbore, the first string having attached thereto a bottomhole assembly for performing a desired downhole operation, the first string further having a first device that enables a second string having a second device to detach the bottomhole assembly from the first string and attach it to the second string within the wellbore;

(c) detaching the bottomhole assembly from the first string and attaching it to the second string;

(d) moving the second string in the wellbore to position the bottomhole assembly at a second position in the wellbore; and (d) operating the bottomhole assembly to perform the desired operation at the second position.

20. The method of claim 20, wherein the desired operation is drilling the wellbore beyond the initial portion of the wellbore.

21. The method of claim 21, wherein the desired operation further includes perforating a desired formation in the wellbore.

22. The method of claim 21, wherein the desired operation further includes placing a sand preventing device adjacent to the perforations in the wellbore.

23. An apparatus for use in a wellbore, comprising:

(a) a first string positioned in the wellbore, the first string having a detachable bottomhole assembly disposed at a known location within the wellbore, the bottomhole assembly being adapted to perform an operation downhole; and (b) a second string adapted to be disposed within the first string, said second string further adapted to disengage the bottomhole assembly from the first string and attach it to the second string, said second string further adapted to move the bottomhole assembly in the wellbore to a second location and to cause the bottomhole assembly to perform the desired operation at the second location.

24. The apparatus as specified in claim 23, wherein the first string is adapted to engage the bottomhole assembly at at least two spaced locations within the first string.

25. The apparatus as specified in claim 24, wherein the second string is adapted to disengage the bottomhole assembly from one of the at least two spaced locations and then reposition the bottomhole assembly at the other spaced location.

26. The apparatus as specified in claim 23, wherein the first string includes a production tubing that is attached to an isolation safety device for isolating the wellbore from the outside environment.

27. The apparatus as specified in claim 26, wherein the second string includes a perforating device for perforating holes in a wellbore formation.

28. The apparatus as specified in claim 27, wherein the secondary string further includes a screen device for preventing entry of debris from the wellbore formation into the first string.

29. The apparatus as specified in claim 28, wherein the bottomhole assembly further includes a gravel packer for packing gravel along a region outside the stationary string.

30. The apparatus as specified in claim 23, wherein the bottomhole assembly includes a drill bit.

31. The apparatus as specified in claim 30, wherein the bottomhole assembly further includes a motor operatively coupled to the drill bit for rotating the drill bit.

32. The apparatus as specified in claim 31, wherein the first string is adapted to allow a pressurized fluid to pass therethrough for operating the motor.

33. The apparatus as specified in claim 32, wherein the bottomhole assembly further includes a measurement-while-drilling device for determining the characteristics of the wellbore formation.

34. The apparatus as specified in claim 33, wherein the measurement-while-drilling device contains a gamma ray device.

35. The apparatus as specified in claim 34, wherein the measurement-while-drilling device further contains an inclination measuring device for providing the orientation of the bottomhole assembly.

36. An assembly for use in a wellbore, comprising:

(a) a stationary string disposed within the wellbore, the stationary string having a bottomhole assembly positioned in the wellbore at a first position; and (b) a secondary string positioned in the stationary string, the secondary string having a detachment device operable with the completion device for detaching the bottomhole assembly from the stationary string and for positioning the bottomhole assembly at a second position that is spaced apart form the first position in the wellbore.

* * * * *